US009812069B2

(12) United States Patent
Lin et al.

(10) Patent No.: US 9,812,069 B2
(45) Date of Patent: Nov. 7, 2017

(54) LCD DISPLAY, A DRIVING DEVICE FOR DRIVING THE LCD DISPLAY, AND A DRIVING METHOD FOR DRIVING THE LCD DISPLAY

(71) Applicant: SHENZHEN CHINA STAR OPTOELECTRONICS TECHNOLOGY CO., LTD., Shenzhen, Guangdong (CN)

(72) Inventors: Poshen Lin, Guangdong (CN); Yong Zhang, Guangdong (CN); Dongsheng Guo, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 430 days.

(21) Appl. No.: 14/504,036

(22) Filed: Oct. 1, 2014

(65) Prior Publication Data

US 2015/0015157 A1 Jan. 15, 2015

Related U.S. Application Data

(63) Continuation of application No. 13/258,760, filed as application No. PCT/CN2011/077646 on Jul. 27, 2011, now abandoned.

(30) Foreign Application Priority Data

Jul. 4, 2011 (CN) ..... 2011 1 0185563

(51) Int. Cl.
*G09G 3/36* (2006.01)
*G09G 3/34* (2006.01)

(52) U.S. Cl.
CPC ..... *G09G 3/3406* (2013.01); *G09G 3/36* (2013.01); *G09G 2320/0233* (2013.01); *G09G 2320/048* (2013.01); *G09G 2320/0673* (2013.01)

(58) Field of Classification Search
CPC ..... G09G 3/3406; G09G 3/36; G09G 2320/0233; G09G 2320/048; G09G 2320/0673
See application file for complete search history.

(56) References Cited

U.S. PATENT DOCUMENTS 8,004,545 B2 * 8/2011 Inuzuka ..... G09G 3/3413 345/102
2005/0219467 A1 10/2005 Nomizo et al.
(Continued)

FOREIGN PATENT DOCUMENTS

CN 1674655 A 9/2005
CN 101452675 A 6/2009
(Continued)

*Primary Examiner* — Jonathan Boyd
(74) *Attorney, Agent, or Firm* — Muncy, Geissler, Olds & Lowe, P.C.

(57) ABSTRACT

The present invention discloses an LCD display and related driving device and driving method. The driving method includes: obtaining an accumulated working time of the LCD display; obtaining a high reference voltage corresponding to the accumulated working time; utilizing the high reference voltage to drive the LCD display; making a multiplying product of a transmittance and a backlight magnitude of the LCD display remain equal or proximity. The present invention suppresses the backlight magnitude decrease phenomenon due to the long-used term of the LCD display such that the display quality can be improved.

11 Claims, 5 Drawing Sheets

(56) References Cited

U.S. PATENT DOCUMENTS

| | | | | |
|---|---|---|---|---|
| 2006/0250323 | A1 | 11/2006 | Wood | |
| 2009/0243987 | A1* | 10/2009 | Chang | G09G 3/3655 345/94 |
| 2009/0273594 | A1 | 11/2009 | Li | |
| 2009/0315872 | A1 | 12/2009 | Ikeda et al. | |
| 2010/0164999 | A1 | 7/2010 | Chan | |
| 2011/0141090 | A1 | 6/2011 | Hong et al. | |

FOREIGN PATENT DOCUMENTS

| | | | |
|---|---|---|---|
| CN | 101542581 | A | 9/2009 |
| CN | 101546528 | A | 9/2009 |
| CN | 101609648 | A | 12/2009 |
| CN | 101770752 | A | 7/2010 |
| CN | 101772799 | A | 7/2010 |
| CN | 102097071 | A | 6/2011 |

* cited by examiner

LCD DISPLAY, A DRIVING DEVICE FOR DRIVING THE LCD DISPLAY, AND A DRIVING METHOD FOR DRIVING THE LCD DISPLAY

CROSS REFERENCE OF RELATED APPLICATION

This application is a continuation application of U.S. application, filed on Sep. 22, 2011 with application Ser. No. 13/258,760. The disclosure of the above-identified application is incorporated herein by reference.

BACKGROUND OF THE INVENTION

1. Field of the Invention

The invention relates to an LCD displaying technology, and more particularly, to an LCD display, a driving device for driving the LCD display, and a driving method for driving the LCD display.

2. Description of the Prior Art

As the population of the LCD technology, functions of the LCD displays are required to be better.

When the LCD is being used, the backlight current decays as time flows. Therefore, if the backlight of the LCD display is used for a long time, this old backlight may introduce a severe backlight current decay. This decreases the luminance of the LCD display and also ruins the still/motion contrast, and finally the display performance of the LCD display becomes unacceptable.

Therefore, how to prevent the backlight magnitude from decaying becomes a new issue.

SUMMARY OF THE INVENTION

It is therefore one of the primary objectives of the claimed invention to provide an LCD display, to solve the above-mentioned problem of decreasing luminance of the LCD display.

According to an exemplary embodiment of the claimed invention, an LCD display is disclosed. The LCD display comprises a storage unit, a timing controller, a pulse width modulation chip, a gamma generating unit, and a driving chip, and the LCD display is characterized in that: the memory is used for storing a relationship between a backlight magnitude and an accumulated working time, a relationship between a transmittance and a high reference voltage, and the transmittance, the backlight magnitude, and a multiplying product of the transmittance and the backlight magnitude when the LCD display is manufactured; the timing controller is used for reading data stored inside the memory; the pulse-width modulation chip is used for generating the high reference voltage according to the accumulated working time and the data transferred from the timing controller; the gamma generating unit is used for generating gamma voltages according to the high reference voltage; and the driving chip is used for receiving the gamma voltages to drive the LCD display; wherein a multiplying product of the backlight magnitude corresponding to the accumulated working time and the transmittance corresponding to the high reference voltage is equal or proximate to the multiplying product of the transmittance and the backlight magnitude when the LCD display is manufactured.

According to another embodiment of the claimed invention, a driving method for driving an LCD display is disclosed. The driving method comprises: obtaining an accumulated working time of the LCD display; obtaining a high reference voltage corresponding to the accumulated working time according to the accumulated working time; and driving the LCD display according to the high reference voltage; wherein a multiplying product of a transmittance and a backlight magnitude of the LCD display remains a substantially fixed value or a proximity value if different reference voltages are applied.

According to another embodiment of the claimed invention, a driving device for driving an LCD display is disclosed. The driving device comprises: an accumulating time obtaining unit, for obtaining an accumulated working time of the LCD display; a voltage matching unit, for obtaining a high reference voltage corresponding to the accumulated working time according to the accumulated working time; and a driving unit, for utilizing the high reference voltage to drive the LCD display; wherein a multiplying product of a transmittance and a backlight magnitude of the LCD display remains a substantially fixed value or a proximity value when different high reference voltages are applied.

According to another embodiment of the claimed invention, an LCD display is disclosed. The LCD display comprises: a driving device for driving the LCD display, the driving device comprising: an accumulating time obtaining unit, for obtaining an accumulated working time of the LCD display; a voltage matching unit, for obtaining a high reference voltage corresponding to the accumulated working time according to the accumulated working time; and a driving unit, for utilizing the high reference voltage to drive the LCD display; wherein a multiplying product of a transmittance and a backlight magnitude of the LCD display remains a substantially fixed value or a proximity value when different high reference voltages are applied.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENT

Figure 1:
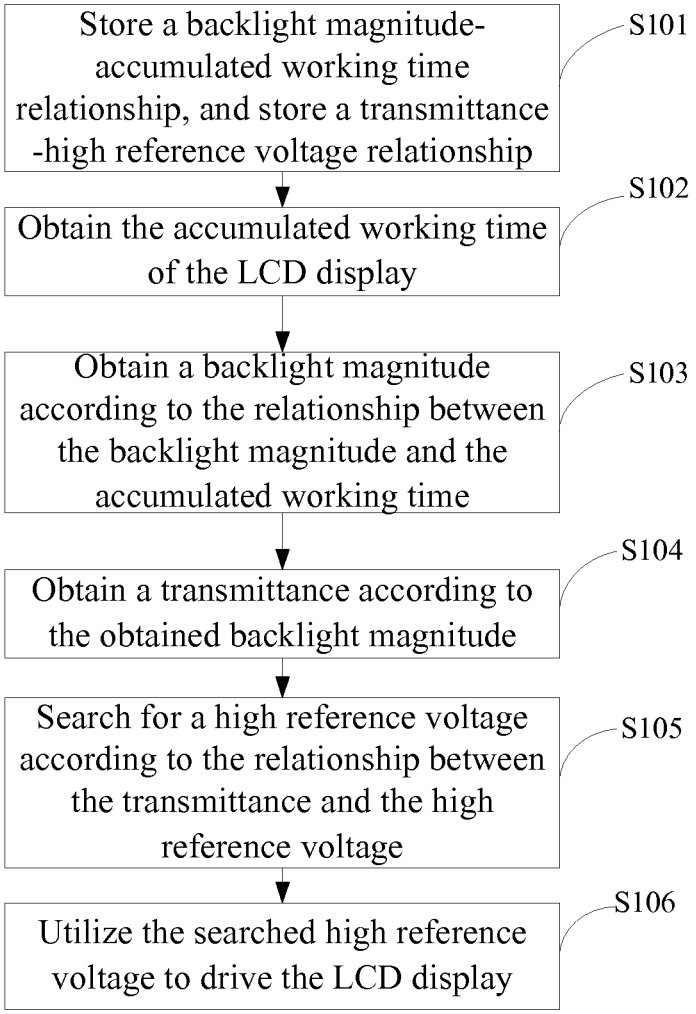
FIG. 1 is a flow chart showing a driving method for driving an LCD display according to a first embodiment of the present invention.

Please refer to FIG. 1, which is a flow chart showing a driving method for driving an LCD display according to a first embodiment of the present invention.

In step S101, the present invention previously stores a relationship between a backlight magnitude and an accumulated working time of an LCD display, and stores a relationship between a transmittance and a high reference voltage of the LCD display.

Please note, the high reference voltage is used for generating driving voltages of the LCD display. In other words, it can be used as the high reference voltage of the gamma curve. In the LCD display, the driving voltages for driving the LCD display are generated by dividing the high reference voltage according to the gamma curve.

Figure 2:
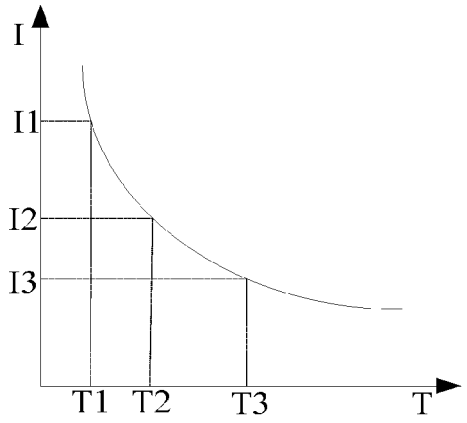
FIG. 2 is a diagram showing a relationship between a backlight magnitude and an accumulated time of the LCD display according to the present invention.

Please refer to FIG. 2, which depicts a relationship between a backlight magnitude and an accumulated time of the LCD display according to the present invention. As shown in FIG. 2, it can be seen that the relationship between the backlight magnitude and the accumulated working time is represented as a curve. Please refer to the aforementioned curve. According to the curve, it is noted that the backlight magnitude I and the accumulated working time is one-by-one corresponding. It means, each backlight magnitude corresponds to only one accumulated working time.

Figure 3:
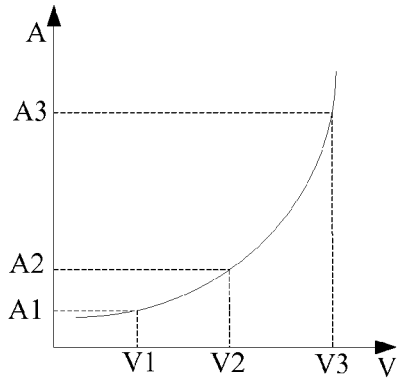
FIG. 3 is a diagram showing a relationship between a transmittance and a high reference voltage of the LCD display according to the present invention.

Please refer to FIG. 3, which depicts a relationship between a transmittance and a high reference voltage of the LCD display according to the present invention. As shown in FIG. 3, the relationship between the transmittance and the high reference voltage of the LCD display is represented as a curve. According to the curve, it is noted that the transmittance A and the high reference voltage V is also one-by-one corresponding. In other words, each transmittance A corresponds to only one high reference voltage V.

Please note, these curves shown in FIG. 2 and FIG. 3 are regarded as embodiments, not limitations of the present invention. In another embodiment of the present invention, look-up tables can be also utilized to illustrate the corresponding relationship between the backlight magnitude and the accumulated working time and the relationship between the transmittance and the high reference voltage. These changes also obey the spirit of the present invention.

In step S102, the present invention obtains the accumulated working time of the LCD display.

Please note, in this embodiment, the accumulated working time of the LCD display is equal to the accumulated working time of the backlight inside the LCD display. The present invention can perform a statics calculation on the accumulated working time of the backlight and further utilize the calculated accumulated working time to fix the problem of backlight current decay due to the aging of the backlight.

For example, the present invention can divide the accumulated working time of the LCD display into 3 time periods: from time of manufacture T1 to time T2, from time T2 to time T3, after time T3. Please note, in the above-mentioned embodiment, only three time periods are disclosed. But in the actual implementation, in order to achieve a better effect and to improve the accuracy, the present invention can divide the accumulated working time into more time periods. This change also obeys the spirit of the present invention, and further illustration is omitted here.

In the actual implementation, the present invention can utilize a counter or a timer, installed inside the LCD display, to obtain the accumulated working time of the LCD display according to a preferred embodiment. Surely, there must be another method for obtaining the accumulated working time, and this method also falls within the scope of the present invention.

In step S103, the present invention obtain a backlight magnitude corresponding to the accumulated working time obtained in step S102 according to the relationship between the backlight magnitude and the accumulated working time (the curve shown in FIG. 2).

In Step S104, the present invention obtains a transmittance according to the backlight magnitude obtained in step S103.

Please note, the principle for obtaining the transmittance is: when different high reference voltages are applied, the multiplying product of the transmittance and the backlight magnitude of the LCD display remains a fixed value or a proximity value.

For example, assume that the backlight magnitudes corresponding to the time T1, T2 and T3 are respectively I1, I2, and I3. The high reference voltages V1, V2, and V3 respectively correspond to transmittances A1, A2, and A3. The multiplying product of the transmittance and the backlight magnitude can be illustrated as the following equation:

$$I1A1=I2A2=I3A3.$$

Here, assume the high reference voltage V1 is the high reference voltage when the LCD display is manufactured (corresponding to the time T1). In the actual implementation, if the above equation cannot be satisfied, the present invention can make I1A1, I2A2 and I3A3 proximate to each other instead of making them totally equal. In this embodiment, when different high reference voltages are applied, the multiplying product of the transmittance and the backlight magnitude of the LCD display remains a fixed value or a proximity value.

In step S105, the present invention search for a high reference voltage corresponding to the transmittance obtained in step S104 according to the relationship between the transmittance and the high reference voltage shown in FIG. 3.

In step S106, the present invention utilizes the high reference voltage searched in step S105 to drive the LCD display.

For example, according to the relationship between the backlight magnitude and the accumulated working time (I-T curve), the present invention divide the accumulated working time into three time periods: from time of manufacture T1 to time T2, from time T2 to time T3, and after time T3. In this embodiment, the backlight magnitudes I1, I2, and I3 are respectively corresponding to the time T1, T2, and T3.

And then, the present invention measures the transmittance when different high reference voltages are applied. For example, when the high reference voltages V1, V2, or V3 is applied, the transmittance is respectively A1, A2, and A3.

In addition, as mentioned previously, in this embodiment, when different high reference voltages V1, V2, and V3 are applied, the backlight magnitude and the transmittance can be illustrated as the following equation:

$$I1A1=I2A2=I3A3.$$

In the embodiment of the present invention, the present invention stores the high reference voltage V1 corresponding to the time of manufacture T1, stores the transmittance A1, backlight magnitude I1, and their multiplying product I1A1 corresponding to time T1. Surely, as mentioned previously, if the above equation is hard to satisfy, the present invention can make I1A1, I2A2 and I3A3 proximate to each other.

The present invention further provides an LCD display, which includes a storage unit, a timing controller, a pulse width modulation chip, a gamma generating unit, and a driving chip.

The storage unit is used for storing the relationship between the backlight magnitude and the accumulated working time and the relationship between the transmittance and the high reference voltage. Furthermore, the storage unit further stores the transmittance, the backlight magnitude, and the multiplying product of the transmittance and the backlight magnitude when the LCD display is manufactured.

The timing controller is used for reading the data stored inside the storage unit.

The pulse width modulation chip is used for generating the high reference voltage according to the accumulated working time of the LCD display and the data read by the timing controller.

The gamma generating unit is used for generating gamma reference voltages according to the high reference voltage and output the gamma reference voltages into the driving chip.

The driving chip is used for driving the LCD display.

In this embodiment, the multiplying product of the backlight magnitude corresponding to the accumulated working time and the transmittance corresponding to the high reference voltage is equal or proximate to the multiplying product of the transmittance and the backlight magnitude when the LCD display is manufactured.

Moreover, the LCD display further includes a counter or a timer. The above-mentioned pulse width modulation chip utilizes the counter or the timer to obtain the accumulated working time of the LCD display.

Figure 4:
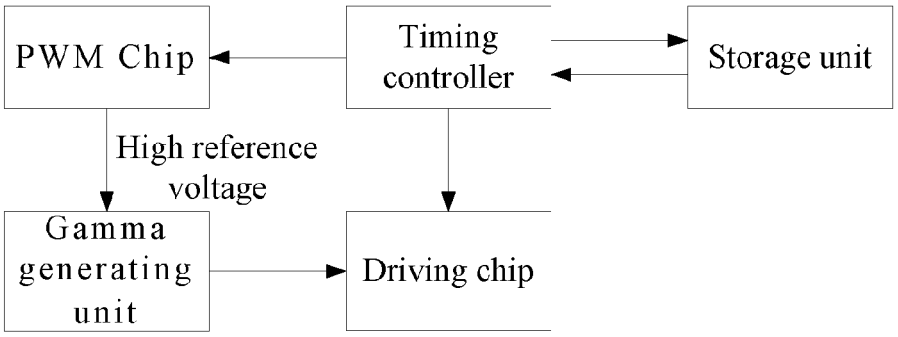
FIG. 4 is a functional block diagram of an LCD display according to a first embodiment of the present invention.

Please refer to FIG. 4, which is a function block diagram of the LCD display according to an embodiment of the present invention. In FIG. 4, T-con indicates the timing controller. PWM IC indicates the pulse width modulation chip, gamma IC indicates the gamma generating unit, source driver indicates the driving chip.

The relationship between the backlight magnitude and the accumulated working time and the relationship between the transmittance and the high reference voltage are inputted into the timing controller. When the LCD display is manufactured, the time T1 is recorded, and the transmittance A1, the backlight magnitude I1, and their multiplying product I1A1 corresponding to time T1 are also recorded. At the time T1, the pulse width modulation chip generates the high reference voltage V1, and the gamma generating unit generates corresponding gamma voltages and input the gamma reference voltages into the driving chip.

When the accumulating time exceeds the time T2, the timing controller reads the data stored inside the storage unit, the pulse width modulation chip generates the high reference voltage V2, and the gamma generating unit generates corresponding gamma voltages and input the gamma reference voltages into the driving chip.

When the accumulating time exceeds the time T3, the timing controller reads the data stored inside the storage unit, the pulse width modulation chip generates the high reference voltage V3, and the gamma generating unit generates corresponding gamma voltages and input the gamma reference voltages into the driving chip.

Through the above steps, the present invention can effectively solve the problem of backlight magnitude decay caused by the aging backlight. This also improves the display quality and ensures that the LCD display can have a better display performance.

Figure 5:
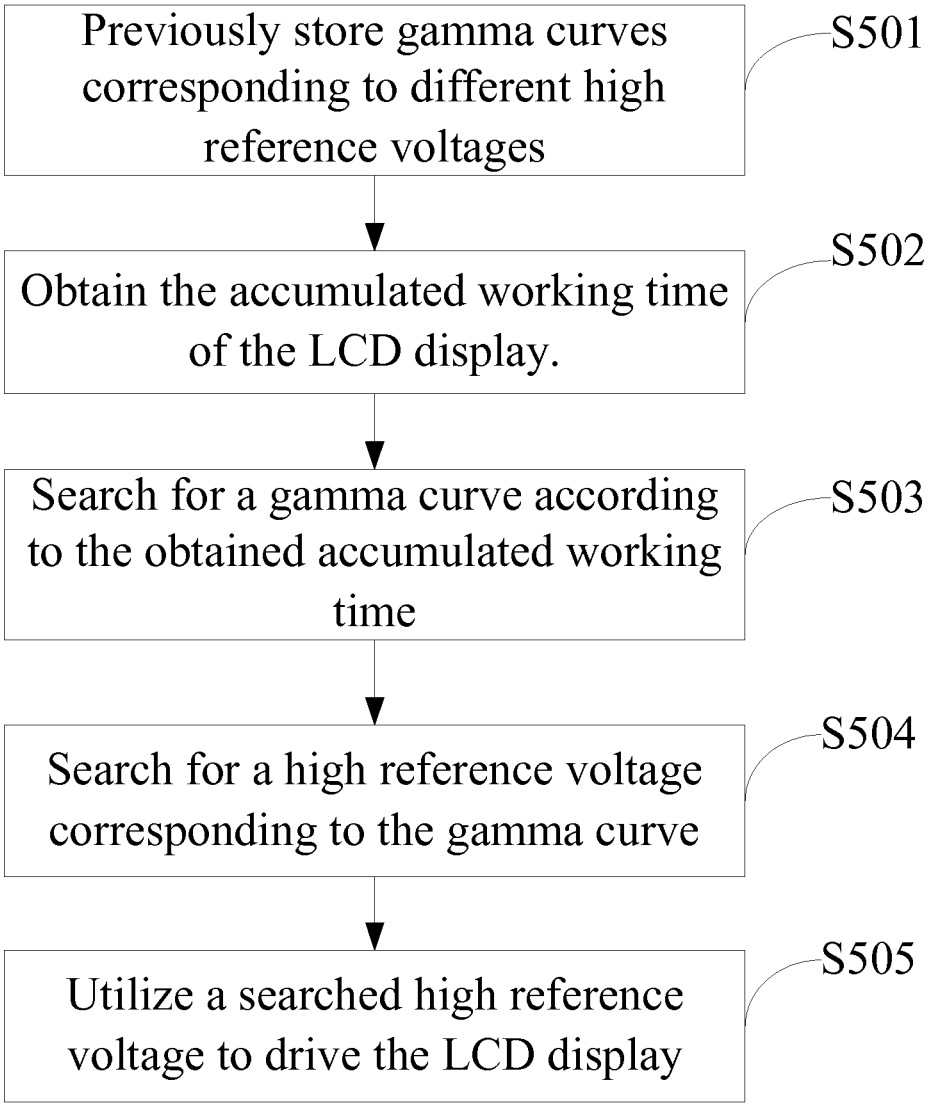
FIG. 5 is a flow chart showing a driving method for driving an LCD display according to a second embodiment of the present invention.

Please refer to FIG. 5, which is a flow chart showing a driving method for driving an LCD display according to a second embodiment of the present invention.

In step S501, the present invention previously stores gamma curves corresponding to different high reference voltages. Here, because the gamma integrated circuit (gamma generating unit) can provide multiple storage banks to store multiple gamma curve. In the actual implementation, the present invention can previously store multiple gamma curves corresponding to different high reference voltage into a memory (storage unit) embedded inside the gamma generating unit or installed outside the gamma generating unit. Please note, the number of the high reference voltages can be determined as a number more than ten or less than ten. The designer can select an appropriate number to save the cost.

Please note, the above-mentioned gamma curve corresponds to the above-mentioned accumulated working time. That is, a specific gamma curve corresponds to a specific time period of the accumulated working time.

In the step S502, the present invention obtains the accumulated working time of the LCD display.

In a preferred embodiment, the present invention utilizes a counter or a timer installed inside the LCD display to obtain the accumulated working time. Surely, other obtaining methods can also be embodied, and they also obey the spirit of the present invention.

In step S503, the present invention search for a gamma curve according to the obtained accumulated working time.

Please note, the high reference voltage on the gamma curve can be illustrated the following conditions: assume that the time of manufacture T1' corresponds to the gamma curve 1, and the transmittance A1', the backlight magnitude I1' and their multiplying product I1'A1' are stored.

Furthermore, time T2' corresponds to the gamma curve 2. The multiplying product I2'A2' of the transmittance A2' corresponding to the high reference voltage V2' and the backlight magnitude I2' is equal to that of the transmittance A1' and the backlight magnitude I1.

$$I'A1'=I2'A2'$$

In a preferred embodiment of the present invention, when different high reference voltages are applied, the present invention makes the multiplying product of the transmittance and the backlight magnitude equal or proximate to the multiplying product of the transmittance and the backlight magnitude when the LCD display is manufactured.

In step S504, the present invention searches for a high reference voltage corresponding to the gamma curve.

In step S505, the present invention utilizes a searched high reference voltage to drive the LCD display.

Figure 6:
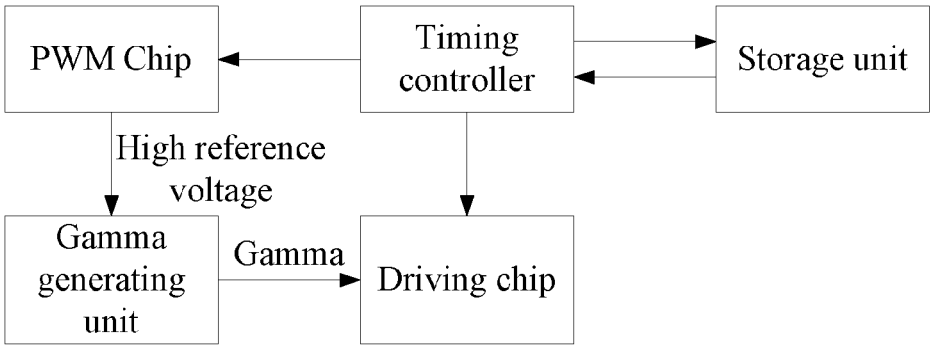
FIG. 6 is a functional block diagram of an LCD display according to a second embodiment of the present invention.

Please refer to FIG. 6, which is a functional block diagram of the LCD display according to another embodiment of the present invention.

In this embodiment, gamma curves corresponding to different high reference voltages are stored into the timing controller. The pulse width modulation chip generates a high reference voltage required by the gamma generating unit. At time T1, the gamma generating unit generate a set of gamma voltages according to gamma curve 1, and inputs the gamma voltages to the driving chip.

At time T2, the pulse width modulation chip generates another high reference voltage required by the gamma generating unit. At time T1, the gamma generating unit generate another set of gamma voltages according to gamma curve 2, and inputs the gamma voltages to the driving chip.

Through the above-mentioned steps, even the backlight magnitude decreases, the present invention can compensate for the backlight magnitude decrease to optimize the display quality of the LCD display.

Figure 7:
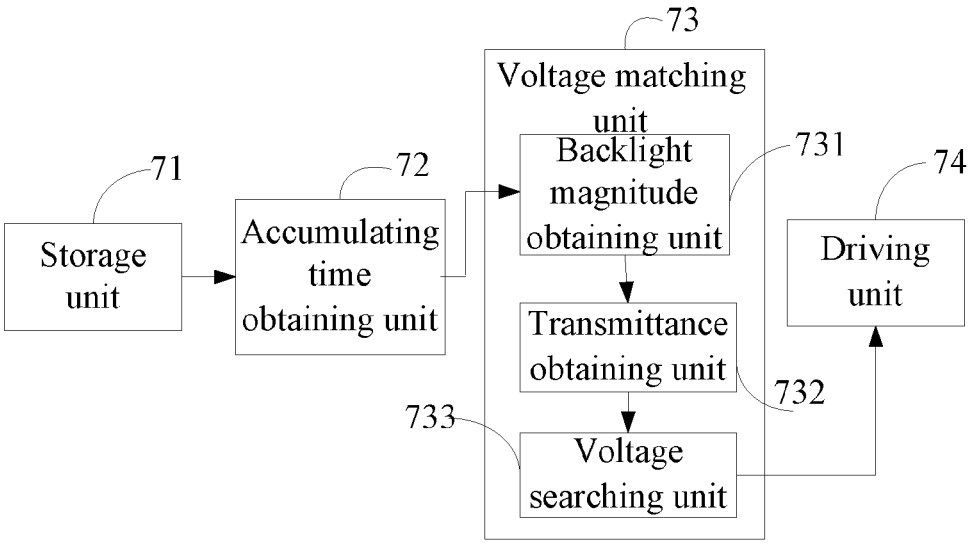
FIG. 7 is a functional block diagram of a driving device of an LCD display according to a first embodiment of the present invention.

Please refer to FIG. 7, which is a functional block diagram depicting a driving device for driving the LCD display according to a first embodiment of the present invention.

In FIG. 7, the storage unit 71 previously stores the relationship between the backlight magnitude and the accumulated working time and the relationship between the transmittance and the high reference voltage.

In an actual implementation, the storage unit 71 further stores the transmittance A, the backlight magnitude I, and their multiplying product corresponding to time T1.

The accumulating time obtaining unit 72 is used for obtaining the accumulated working time of the LCD display.

In an actual implementation, the LCD display further comprises a counter or a timer. The above-mentioned time obtaining unit 72 utilizes the counter or the timer to obtain the accumulated working time of the LCD display.

The voltage matching unit 73 obtains a high reference voltage corresponding to the accumulated working time of the LCD display.

Moreover, in this embodiment, the multiplying product of the transmittance and the backlight magnitude remains a fixed value or a proximity value when different high reference voltages are applied.

The driving unit 74 utilizes the high reference voltage obtained by the voltage matching unit 73 to drive the LCD display.

In an actual implementation, the above-mentioned voltage matching unit 73 comprises a backlight magnitude obtaining unit 731, a transmittance obtaining unit 732, and a voltage searching unit 733.

The backlight magnitude obtaining unit 731 is used for obtaining the backlight magnitude corresponding to the accumulated working time obtained by the accumulating time obtaining unit 72 according to the relationship between the backlight magnitude and the accumulated working time.

The transmittance obtaining unit 732 is used for obtaining the transmittance corresponding to the backlight magnitude obtained by the backlight magnitude obtaining unit 731, where when the transmittance obtaining unit 732 obtains transmittance, the transmittance obtaining unit 732 makes the multiplying product of the transmittance and the backlight magnitude of the LCD display remains the substantially fixed value or the proximity value when different high reference voltages are applied; and The voltage searching unit 733 is used for searching for the high reference voltage corresponding to the obtained transmittance according to the relationship between the transmittance and the high reference voltage.

Figure 8:
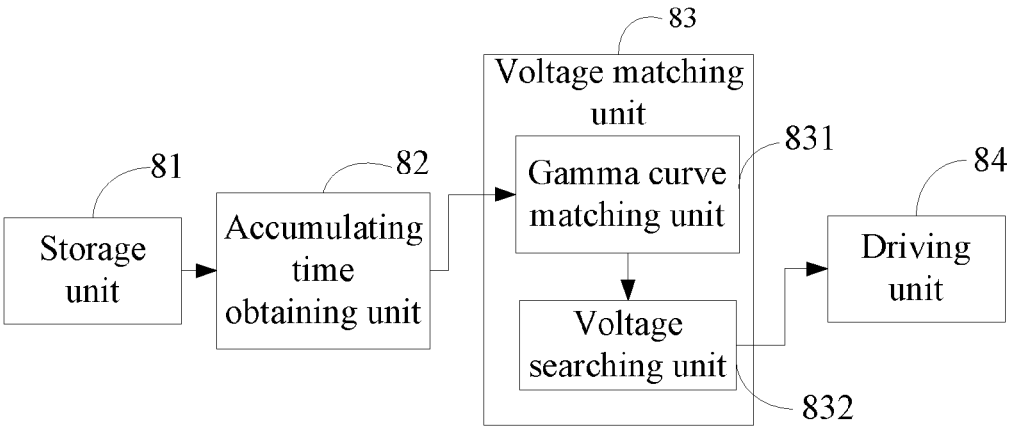
FIG. 8 is a functional block diagram of a driving device of an LCD display according to a second embodiment of the present invention.

Please refer to FIG. 8, which is a functional block diagram depicting a driving device for driving the LCD display according to a second embodiment of the present invention.

In this embodiment, the storage unit 81 previously stores gamma curves, where the gamma curves corresponds to accumulated working time.

Furthermore, the storage unit 81 is further used for storing the transmittance A, the backlight magnitude I and their multiplying product corresponding to time T1.

The accumulating time obtaining unit 82 is used to obtain the accumulated working time of the LCD display.

The voltage matching unit 83 obtains a corresponding high reference voltage.

The driving unit 84 utilizes the obtained high reference voltage to drive the LCD display.

In this embodiment, when obtaining the high reference voltage, the voltage matching unit 83 make the multiplying product of the transmittance and the backlight magnitude equal or proximate to that of the transmittance and the backlight magnitude when different high reference voltages are applied.

In an actual implementation, the voltage matching unit 83 comprises a gamma curve matching unit 831 and a voltage searching unit 832.

The gamma curve matching unit 831 is used for obtaining the gamma curve corresponding to the accumulated working time.

The voltage searching unit 832 is used for searching for the high reference voltage corresponding to the gamma curve obtained by the gamma curve matching unit, where a specific gamma curve corresponds to a specific high reference voltage, and the multiplying product of the transmittance and the backlight magnitude remains equal or proximity if different high reference voltages are applied.

Please note, the working theory of the driving device has been illustrated in the above disclosure, and further illustration is omitted here.

The present invention further provides an LCD display, which includes the above-mentioned driving device. Since the driving device has been disclosed in the above disclosure, further illustration is omitted here.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A liquid crystal display (LCD) comprising:

a memory for storing a relationship between a backlight magnitude and an accumulated working time, a relationship between a transmittance and a high reference voltage, and the transmittance, the backlight magnitude, and a multiplying product of the transmittance and the backlight magnitude when the LCD display is manufactured;

a timing controller for reading data stored inside the memory;

a pulse-width modulation chip for generating the high reference voltage according to the accumulated working time and the data transferred from the timing controller;

a gamma generating unit for generating gamma voltages according to the high reference voltage; and a driving chip for receiving the gamma voltages to drive the LCD display;

wherein a multiplying product of the backlight magnitude corresponding to the accumulated working time and the transmittance corresponding to the high reference voltage is equal or proximate to the multiplying product of the transmittance and the backlight magnitude when the LCD display is manufactured.

2. The LCD display of claim 1, wherein the LCD display further comprises a counter/timer, for calculating the accumulated working time, the pulse-width modulation chip obtains the calculating the accumulated working time from the counter/timer.

3. A driving method for driving an LCD display, comprising:

storing a plurality of gamma curves corresponding to a plurality of accumulated working times;

obtaining a selected accumulated working time of the LCD display from the plurality of accumulated working times;

searching for the gamma curve corresponding to the selected accumulated working time;

searching for a high reference voltage corresponding to the gamma curve; and driving the LCD display according to the high reference voltage;

wherein a multiplying product of a transmittance and a backlight magnitude of the LCD display remains a substantially fixed value or a proximity value if different reference voltages are applied.

4. The driving method of claim 3, further comprising:

recording the transmittance, the backlight magnitude, and the multiplying product of the transmittance and the backlight magnitude when the LCD is manufactured; and when searching for the high reference voltage, making the multiplying product of the backlight magnitude corresponding to the accumulated working time and the transmittance corresponding to the high reference voltage equal or proximate to a multiplying product of the transmittance and the backlight magnitude when the LCD display is manufactured.

5. The driving method of claim 3, wherein the step of obtaining the accumulated working time of the LCD display comprises:

utilizing a counter/timer installed in the LCD display to obtain the accumulated working time of the LCD display.

6. A driving device for driving an LCD display, comprising:

an accumulating time obtaining unit, for obtaining an accumulated working time of the LCD display;

a voltage matching unit, for obtaining a high reference voltage corresponding to the accumulated working time according to the accumulated working time;

a driving unit, for utilizing the high reference voltage to drive the LCD display;

a storage device for storing a plurality of gamma curves, the plurality of gamma curves corresponding to a plurality of accumulated working times;

wherein the voltage matching unit further comprises:

a gamma curve matching unit, for obtaining the gamma curve corresponding to the accumulated working time;

wherein a multiplying product of a transmittance and a backlight magnitude of the LCD display remains a substantially fixed value or a proximity value when different high reference voltages are applied;

wherein the voltage searching unit is further used for searching for the high reference voltage corresponding to the gamma curve obtained by the gamma curve matching unit; and wherein each gamma curve corresponds each high reference voltage, and the multiplying product of the transmittance and the backlight magnitude remains equal or proximity if different high reference voltages are applied.

7. The driving device of claim 6, wherein the storage unit is further used for storing the transmittance, the backlight magnitude, and the multiplying product of the transmittance and the backlight magnitude when the LCD display is manufactured; and the voltage matching unit makes the multiplying product of the transmittance and the backlight magnitude of the LCD display when different high reference voltages are applied remain equal or proximate to the multiplying product of the transmittance and the backlight magnitude when the LCD display is manufactured.

8. The driving device of claim 6 further comprising a counter/timer, wherein the accumulating time obtaining unit utilizes the counter/timer to obtain the accumulated working time.

9. An LCD display, comprising:

a driving device for driving the LCD display, the driving device comprising:

an accumulating time obtaining unit, for obtaining an accumulated working time of the LCD display;

a voltage matching unit, for obtaining a high reference voltage corresponding to the accumulated working time according to the accumulated working time; and a driving unit, for utilizing the high reference voltage to drive the LCD display;

a storage device for storing a gamma curve, the gamma curve corresponds to the accumulated working time; and the voltage matching unit further comprises:

a gamma curve matching unit, for obtaining the gamma curve corresponding to the accumulated working time;

a voltage searching unit, for searching for the high reference voltage corresponding to the obtained transmittance according to the relationship between the transmittance and the high reference voltage;

wherein a multiplying product of a transmittance and a backlight magnitude of the LCD display remains a substantially fixed value or a proximity value when different high reference voltages are applied, wherein the voltage searching unit is further used for searching for the high reference voltage corresponding to the gamma curve obtained by the gamma curve matching unit; and wherein each gamma curve corresponds each high reference voltage, and the multiplying product of the transmittance and the backlight magnitude remains equal or proximity if different high reference voltages are applied.

10. The LCD display of claim 9, wherein the storage unit is further used for storing the transmittance, the backlight magnitude, and the multiplying product of the transmittance and the backlight magnitude when the LCD display is manufactured; and the voltage matching unit makes the multiplying product of the transmittance and the backlight magnitude of the LCD display when different high reference voltages are applied remain equal or proximate to the multiplying product of the transmittance and the backlight magnitude when the LCD display is manufactured.

11. The LCD display of claim 9 further comprising a counter/timer, wherein the accumulating time obtaining unit utilizes the counter/timer to obtain the accumulated working time.

* * * * *